US005397264A

United States Patent [19]

Gross

[11] Patent Number: 5,397,264

[45] Date of Patent: Mar. 14, 1995

[54] CASH DRAWER COIN COUNTER

[76] Inventor: Ira Gross, 468 Golf Ct. N., Woodmere, N.Y. 11581

[21] Appl. No.: 172,043

[22] Filed: Dec. 22, 1993

[51] Int. Cl.[6] ..... G07D 9/06

[52] U.S. Cl. ..... 453/37; 453/60; 453/62

[58] Field of Search ..... 453/18, 19, 23, 29, 453/37, 58, 60, 61, 62; 206/0.8, 0.81, 0.84

[56] References Cited

U.S. PATENT DOCUMENTS

| | | | |
|---|---|---|---|
| 518,676 | 4/1894 | Nall | 453/60 X |
| 1,121,815 | 12/1914 | Eaton et al. | 453/58 X |
| 1,618,390 | 2/1927 | Smith | 453/62 |
| 2,416,486 | 2/1947 | Leese | 453/37 |
| 2,646,055 | 7/1953 | Neilsen | 453/58 |
| 2,926,673 | 3/1960 | Bernard | 453/37 X |
| 2,932,333 | 4/1960 | Farricielli | 206/0.81 X |
| 3,265,077 | 8/1966 | Kirkpatrick | 453/60 |
| 3,435,833 | 4/1969 | Tanaka | 453/60 X |
| 3,678,650 | 7/1972 | Green, Jr. | 453/62 X |

FOREIGN PATENT DOCUMENTS

| | | | |
|---|---|---|---|
| 2034417 | 7/1992 | Canada | 206/0.8 |

*Primary Examiner*—Michael S. Huppert
*Assistant Examiner*—Scott L. Lowe
*Attorney, Agent, or Firm*—Notaro & Michalos

[57] ABSTRACT

A cash drawer coin counter is in combination with a cash drawer and has a width and a plurality of individual coin compartments spaced along the width. A frame of the counter has opposite side walls for being positioned on opposite sides of the cash drawer, and a body fixed between the side walls for being positioned above the cash drawer. Each side wall has a rail below the body, and a release platform is slidably engaged to the rail and moveable between a first position at least partially covering a lower surface of the body, and a second position exposing the lower surface of the body. The body including a plurality of spaced, open-ending cylindrical chambers each aligned with one of the coin compartments and each having a front access slot through a front wall of the body. Each chamber is of a diameter for receiving one denomination of coins to be stacked above the platform with the platform in its first position. A vertical scale is adjacent each slot of each chamber and indicating a number of coins staked in each chamber. Each chamber has an upper open end extending through an upper surface of the body and ending in a flared funnel converging into the upper opening of each chamber for facilitating loading each chamber with coins.

14 Claims, 2 Drawing Sheets

CASH DRAWER COIN COUNTER

FIELD AND BACKGROUND OF THE INVENTION

Present invention relates in general to coin counters, and in particular to a new and useful cash drawer coin counter which is structured to align stacks of different coin denominations over appropriate locations in a cash drawer, and with a movement of a single release platform, deposit the counted change into correct receptacles in the cash drawer.

A wide variety of coin counters exist in the prior art.

U.S. Pat. No. 76,492, for example, discloses an apparatus for sorting coins according to denomination, when the mixed coins are dropped into a hopper at the top of the device.

A toy safe is disclosed in U.S. Pat. No. 305,587 which has spaced tubes in a frame for receiving coins in different denominations.

A coin separator which automatically drops coins into a correct location in a cash drawer when the coins are deposited in mixed bulk into the device, is disclosed in U.S. Pat. No. 264,425. A coin sorting apparatus is also disclosed in U.S. Pat. No. 641,496. Also see U.S. Pat. No. 802,550 for a coin handling machine and U.S. Pat. Nos. 1,378,720; 2,764,990 and 3,135,270 for other coin counting or sorting devices.

SUMMARY OF THE INVENTION

An object of the present invention is to provide a mechanically simple yet very effective coin counting and coin depositing mechanism which can be loaded in a simple manipulation that requires presorting of the coins, and which provides a clear visual indication of how much of each denomination is present. The coins can then automatically be deposited into the appropriate compartments of a cash drawer with a single movement.

While the invention can be used to load known amounts of coins of different denominations into the coin compartments of a cash drawer, it can also be used to quickly count coins in a cash drawer after it has been used, at the end of a shift at a retail store. Those responsible for counting coins in cash drawers, such as cashiers, bookkeepers and retail store managers, can count the coin totals more quickly and accurately using the coin counter of the present invention. The coins can then be returned to the drawers in one operation by placing the coin counter over the coin compartments and releasing the coins into the coin compartments.

Verification of coin count, that is an additional count of coins made by a second party to confirm the original coin count, and discrepancy counts, that is an additional coin count made due to an error of the original count or the verification count, are common examples of excessive coin handling which can be minimized or eliminated using the present invention.

In the past, coin counters have either been too complex or not been functional enough to work well with cash register drawers. This problem has now been solved according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENTS

Figure 1:
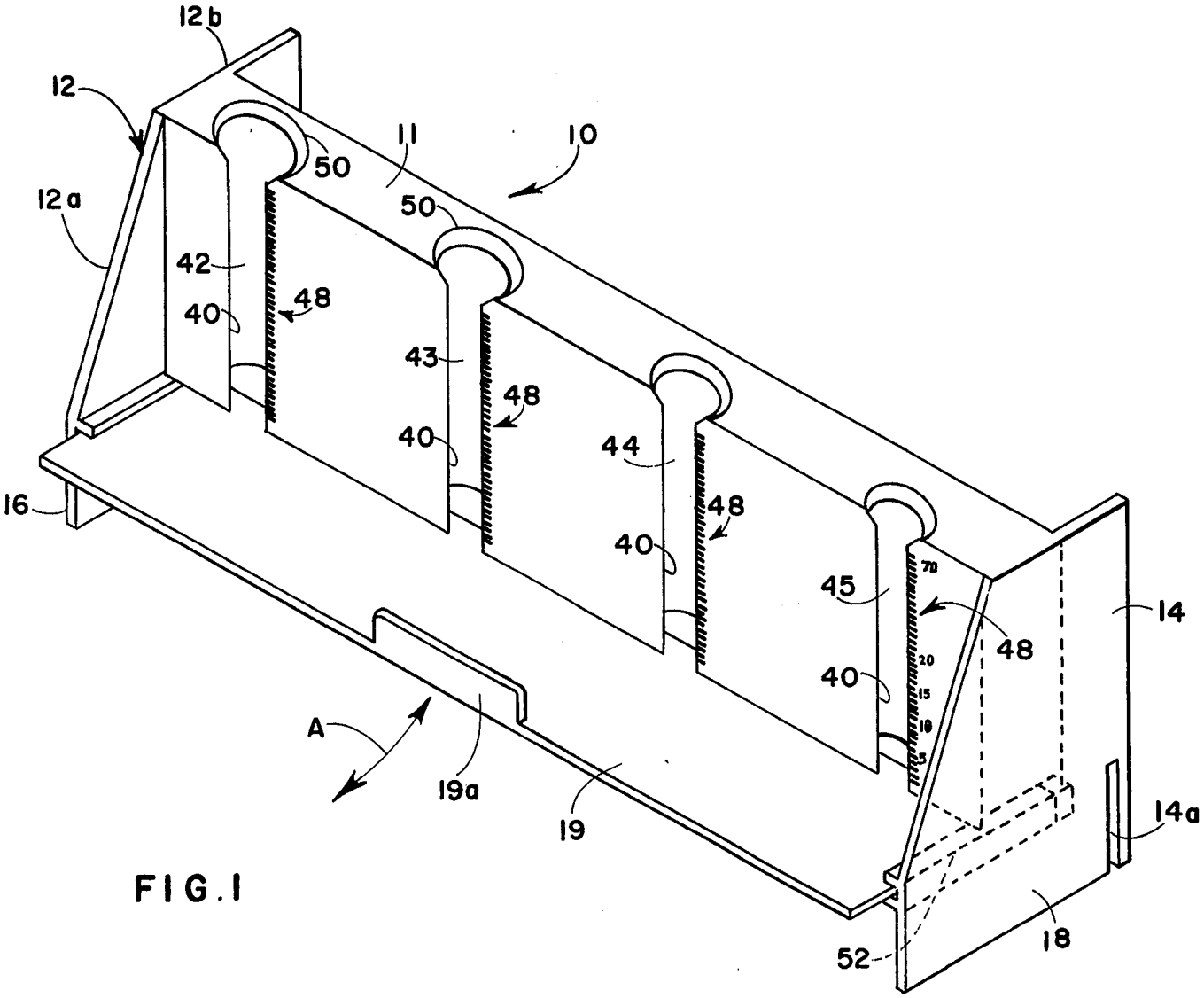
FIG. 1 is a perspective view of the cash drawer coin counter according to the invention.

Referring to the drawings in particular, the invention embodied therein comprises a frame generally designated 10 having a pair of side walls 12 and 14 which are spaced from each other by an amount to straddle a cash drawer generally designated 20. Standard cash drawers are 12 inches wide and 2.5 inches high. As is known, cash drawer 20 may include a plurality of rear compartments 22, 24, 26 and 28 for receiving paper money in different denominations. A variety of levers and springs (not shown) may also be provided for retaining the paper bills in the receptacles. These are not shown since they form no part of the present invention.

Usually at the front of the cash drawer 20, are a plurality of coin receptacles 32, 34, 36 and 38, each for receiving different denomination of coins such as quarters, dimes, nickels and pennies. Five receptacles or more may also be provided to include a miscellaneous receptacle for odd coins, such as half-dollars which are rarely in circulation, or multiple receptacles may be provided for a single denomination, for example two or three receptacles for quarters. This depends on the frequency with which certain coins are received at certain establishments using the cash drawer.

Figure 2:
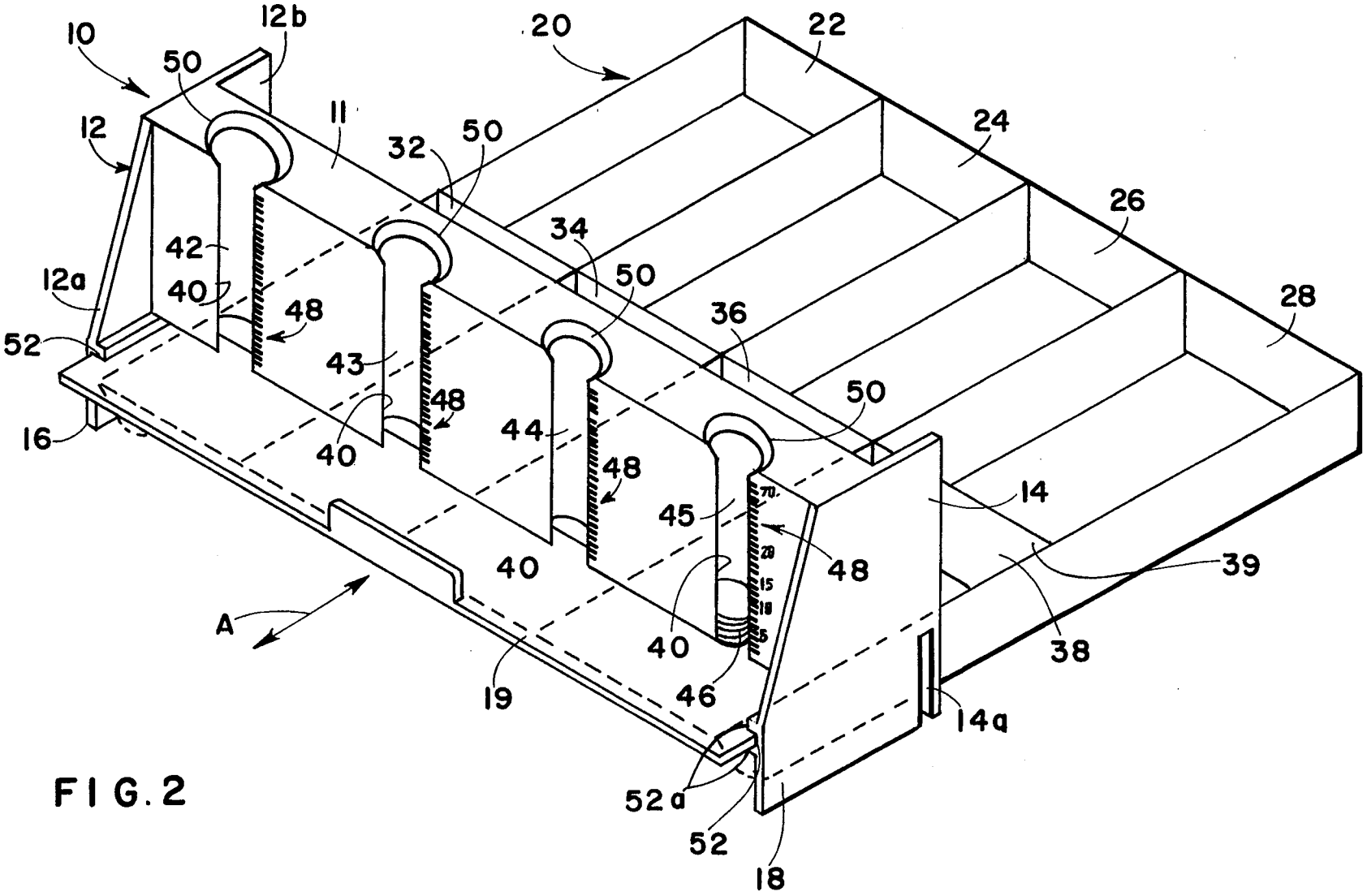
FIG. 2 is a view somewhat of FIG. 1 showing the invention in use above a cash drawer.

As best shown in FIG. 2, each of the side walls 12, 14 have respective lower ends 16, 18 which extend below a moveable platform or release bar 19 which is moveable in the direction of double arrow A between the walls and above the front end of cash drawer 20. The lower ends 16, 18 of wall 12, 14 are at least 2.5 inches high but no more than 4 inches high so that the draw fits beneath frame 10 on opposite sides of the lower wall portions 16, 18.

Frame 10 also includes a central body 11 which is in the form of a solid or hollow rectangular structure pierced by vertically extending, open-ended substantially cylindrical coin chambers 42, 43, 44 and 45. Tubes 42 to 45 are made in one piece with body 11 and may be of metal or plastic.

Each chamber has a vertically extending front access slot 40 through which coins shown for example at 46, can be seen and touched for manipulation. For example a narrow tool can be used to correct the stacking of coins through slot 40, if needed.

A vertical scale 48 is provided adjacent each slot 40. Each scale 48 is calibrated to count coins having a known thickness and meant to be deposited in the respective chambers 42–45. Thus currency total can be seen for each coin denomination in each tube.

An alternate design could include an electric coin counting feature that could give a money total of all combined chambers and/or individual chambers.

Each cylindrical chamber 42–45 has an upper funnel or flared entry 50 at its upper open end. This facilitates a dropping of a hand-full of coins of the same denomination into the top opening of each chamber. By manipulating or restraining the coins as they drop, by access through the slots 40, they can be neatly staked as shown at 46 in FIG. 2.

Once the proper selection of coins has been loaded into the body 11, for example $5.00 worth of quarters in chamber 42, $2.00 worth of dimes in chamber 43, $1.00 worth of nickels in chamber 44 and $0.25 worth of pennies in chamber 45, release platform 19 is pulled to the left in the figures, causing all of the coins in each chamber to neatly drop into their respective compartment 32, 34, 36 and 38, which are automatically aligned below each compartment, respectively. Chamber capacity will average about 60 coins each.

Thus, the invention can be used to load a cash drawer before a shift. The invention can also be used to check the amount of coinage in a cash drawer after a shift, by any appropriate personnel such as the cashier, a bookkeeper or other appropriate individual. This is easily done by placing the invention in a position straddling the cash drawer but at a location either in front of or behind the coin compartments so that the coins can be loaded into their respective tubes. This is done with the platform 19 in its first rearward position between the side walls and under the lower open ends of the coin compartments. Once all the coins are loaded into the appropriate compartments, a total currency is taken and then the counter 10 can be moved to a location with the coin compartments aligned over a respective coin receptacle. Platform 19 is then pulled out from under the body 11 to drop the coins into the appropriate coin receptacle.

Side walls 12 and 14 also have rearwardly extending wings **12*b* that extend rearwardly of body 11 to help provide a broader bottom wall portion 16, 18 to hold the frame 10 in a proper location over the drawer 20 and keep it stable. Each side wall is a polygon with five sides and has triangular gussets 12*a* which extend from the top front corner of each wall to the top front of each lower portion. However, the sidewalls could be shaped differently such as a triangle. A slot 52 defined between two rails 52*a* on the inner surface of each side wall 12, 14, provides a sliding channel for release platform 19. An upstanding tab 19*a* may be provided near the center front edge of platform 19** to make it easier to pull and push the platform between its two positions.

A vertical slot, shown for example at **14*a*, at the rear of each side wall 12 and 14, is also provided in case a cash drawer 12 which is overly broad must be serviced. In that case slot 14*a* can be positioned to engage a rear wall 39 separating coin compartments from paper money compartments, to firmly position the frame 10** with respect to the cash drawer.

The entire frame 10 with its body 11, walls 12, 14 and release bar or platform 19 may be made of rigid plastic material or metal.

While a specific embodiment of the invention has been shown and described in detail to illustrate the application of the principles of the invention, it will be understood that the invention may be embodied otherwise without departing from such principles.

What is claimed is:

1. A cash drawer coin counter assembly comprising:

a cash drawer having a width and a plurality of individual coin compartments spaced along the width;

a frame having opposite side walls for being positioned on opposite sides of the cash drawer, and a body fixed between the side walls for being positioned above the cash drawer;

each side wall having rail means below said body;

a release platform slidably engaged to said rail means and moveable between a first position at least partially covering a lower surface of the body, and a second position exposing the lower surface of the body;

the body including a plurality of spaced, vertically extending open ended cylindrical chambers each aligned with one of the coin compartments and each having a front access slot through a front wall of said body, each chamber being of a diameter for receiving one denomination of coins to be stacked above the platform with the platform in its first position, a vertical scale adjacent each slot of each chamber for indicating a currency total of coins stacked in each chamber, each chamber having an upper open end extending through an upper surface of said body and ending in a flared funnel converging into the upper open end of each chamber for facilitating loading each chamber with coins;

each side wall having a lower portion extending below said rail means with a vertical dimension sufficient to maintain the body and the platform above the coin compartments in the cash drawer.

2. A cash drawer coin counter assembly according to claim 1, wherein each side wall includes a portion extending rearwardly of the body, each rearwardly extending portion having a lower vertically extending slot.

3. A cash drawer coin counter assembly according to claim 2, wherein each side wall includes a triangular gusset portion diverging from an upper front edge of each side wall to a lower front end of each rail means, each side wall being a polygon with five sides.

4. A cash drawer coin counter assembly according to claim 3, wherein said platform includes a forward edge with an upwardly extending tab near a center of said forward edge.

5. A cash drawer coin counter assembly according to claim 1, wherein the lower portion of each side wall has a vertical dimension of between 2.5 and 4 inches, the side walls being spaced apart by at least 12 inches.

6. A cash drawer coin counter assembly according to claim 5, wherein each side wall includes a triangular gusset portion diverging from an upper front edge of each side wall to a lower front end of each rail means, each side wall being a polygon with five sides.

7. A cash drawer coin counter assembly according to claim 6, wherein said platform includes a forward edge with an upwardly extending tab near a center of said forward edge.

8. A cash drawer coin counter assembly according to claim 7, wherein each side wall includes a portion extending rearwardly of the body.

9. A cash drawer coin counter assembly according to claim 8, wherein the body is made of one piece of material with the cylindrical chambers and flared funnels.

10. A cash drawer coin counter assembly according to claim 1, wherein the body is made of one piece of material with the cylindrical chambers and flared funnels.

11. A cash drawer coin counter comprising:

a frame having opposite side walls for being positioned on opposite sides of a cash drawer, and a body fixed between the side walls for being positioned above the cash drawer;

each side wall having rail means below said body;

a release platform slidably engaged to said rail means and moveable between a first position at least partially covering a lower surface of the body, and a second position exposing the lower surface of the body;

the body including a plurality of spaced, vertically extending open ended cylindrical chambers each for being aligned with a different coin compartment of the cash drawer and each having a front access slot through a front wall of said body, each chamber being of a diameter for receiving one denomination of coins to be stacked above the platform with the platform in its first position, a vertical scale adjacent each slot of each chamber for indicating a currency total of coins stacked in each chamber, each chamber having an upper open end extending through an upper surface of said body and ending in a flared funnel converging into the upper open end of each chamber for facilitating loading of each chamber with coins; and each side wall having a lower portion extending below said rail means with a vertical dimension sufficient to maintain the body and the platform above cash compartments in the cash drawer.

12. A method of loading coin compartments of a cash drawer, the coin compartments being spaced across a width of the cash drawer, comprising:

positioning a frame over the coin compartments, the frame having opposite side walls on opposite sides of the cash drawer and a body fixed between the side walls and spanning the width of the cash drawer with a vertically extending open ended cylindrical coin chamber positioned in alignment above each coin compartment, each for receiving a stack of coins for deposition into a respective coin compartment, the frame including a slidable release platform slidably mounted between the side walls, and moveable between a first position covering lower open ends of the coin chambers and a second position exposing lower open ends of the coin chambers to allow coins in the coin chambers to drop into the coin compartments;

filling each coin compartment with coins of a selected denomination to a selected height in each coin compartment;

reading an amount of coins in each coin compartment from markings on a surface of said body, adjacent a vertically extending slot in each body communicating with each coin chamber respectively; and once coins of selected denomination are loaded into each chamber to a selected amount, pulling the release platform from its first position to its second position to deposit the coins into their respective coin compartments.

13. A method according to claim 12, including providing a funnel shaped area at the upper open end of each coin chamber for facilitating loading of each coin chamber with coins.

14. A method according to claim 13, including providing rail means on inner surfaces of each side wall, each side wall being polygonal in shape with five sides, each side wall including a triangular gusset extending from an upper forward corner of each side wall to a front end of each guide rail.

* * * * *